US008707704B2

(12) United States Patent
Simons et al.

(10) Patent No.: US 8,707,704 B2
(45) Date of Patent: Apr. 29, 2014

(54) METHOD AND APPARATUS FOR ASSEMBLING TURBINE ENGINES

(75) Inventors: Derrick Walter Simons, Greer, SC (US); Jeffrey Scott Lebegue, Simpsonville, SC (US); Krishna Kumar Venkataraman, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1380 days.

(21) Appl. No.: 11/756,448

(22) Filed: May 31, 2007

(65) Prior Publication Data

US 2008/0295521 A1 Dec. 4, 2008

(51) Int. Cl.
*F02C 1/00* (2006.01)

(52) U.S. Cl.
USPC ..... 60/749; 60/752

(58) Field of Classification Search
USPC ..... 60/737, 749, 752, 755–760
See application file for complete search history.

(56) References Cited

U.S. PATENT DOCUMENTS

| | | | | |
|---|---|---|---|---|
| 4,246,757 | A * | 1/1981 | Heberling | 60/737 |
| 4,984,429 | A * | 1/1991 | Waslo et al. | 60/752 |
| 5,117,636 | A | 6/1992 | Bechtel, II et al. | |
| 5,156,002 | A | 10/1992 | Mowill | |
| 5,575,146 | A | 11/1996 | Borkowicz et al. | |
| 6,279,323 | B1 | 8/2001 | Monty et al. | |
| 6,405,523 | B1 | 6/2002 | Foust et al. | |
| 6,427,446 | B1 | 8/2002 | Kraft et al. | |
| 6,430,932 | B1 * | 8/2002 | Martling et al. | 60/760 |
| 6,446,438 | B1 | 9/2002 | Kraft et al. | |
| 6,497,103 | B2 | 12/2002 | Johnson et al. | |
| 6,772,595 | B2 | 8/2004 | Martling et al. | |
| 6,832,482 | B2 * | 12/2004 | Martling et al. | 60/737 |
| 6,925,809 | B2 | 8/2005 | Mowill | |
| 7,000,403 | B2 * | 2/2006 | Henriquez et al. | 60/776 |
| 7,707,836 | B1 * | 5/2010 | Barnes et al. | 60/755 |
| 2004/0112058 | A1 * | 6/2004 | Garrido et al. | 60/752 |

* cited by examiner

*Primary Examiner* — Gerald L Sung
(74) *Attorney, Agent, or Firm* — Armstrong Teasdale LLP

(57) ABSTRACT

A method of assembling a turbine engine includes defining a first chamber and defining a second chamber. The method also includes forming at least one venturi device oriented with a predetermined venturi step angle greater than approximately 48°. The method further includes coupling the first chamber in flow communication with the second chamber via the venturi device therebetween.

14 Claims, 3 Drawing Sheets

METHOD AND APPARATUS FOR ASSEMBLING TURBINE ENGINES

BACKGROUND OF THE INVENTION

This invention relates generally to rotary machines and more particularly, to methods and apparatus for operating gas turbine engines.

At least some known gas turbine engines combust a fuel and air mixture to release heat energy from the mixture to form a high temperature combustion gas stream that is channeled to a turbine via a hot gas path. The turbine converts thermal energy from the combustion gas stream to mechanical energy that rotates a turbine shaft. The output of the turbine may be used to power a machine, such as, for example, an electric generator or a pump.

At least one by-product of the combustion reaction may be subject to regulatory limitations. For example, within thermally-driven reactions, nitrogen oxide ($NO_x$) may be formed by reactions between nitrogen and oxygen in the air initiated by the high temperatures during the combustion process. Moreover, carbon monoxide (CO) may be formed by reactions between carbon and oxygen in the air and fuel. Generally, engine efficiency increases as the temperature of the combustion gas stream entering a turbine section of the engine increases. Such increases in efficiency facilitate mitigating CO formation. However, increasing the combustion gas temperature may undesirably increase the formation of $NO_x$.

To control $NO_x$ emissions during turbine engine operation, at least some known gas turbine engines use combustors that operate with a lean fuel/air ratio and with fuel that is premixed with air prior to being supplied into the combustor. Premixing may facilitate reducing combustion temperatures and subsequently reducing $NO_x$ formation. However, there may be limiting parameters associated with decreasing combustion temperatures, such as, for example, CO formation and lean blowout.

BRIEF DESCRIPTION OF THE INVENTION

In one aspect, a method of assembling a turbine engine is provided. The method includes defining a first chamber and defining a second chamber. The method also includes forming at least one venturi device oriented with a predetermined venturi step angle greater than approximately 48°. The method further includes coupling the first chamber in flow communication with the second chamber via the venturi device therebetween.

In another aspect, a combustor assembly is provided. The combustor assembly includes a first chamber and a second chamber coupled in flow communication with the first chamber. The assembly also includes at least one venturi device between the first and second chambers, wherein the venturi device is oriented with a predetermined venturi step angle greater than approximately 48°.

In a further aspect, a turbine engine is provided. The engine includes at least one air source, at least one fuel source, and at least one cooling fluid source. The engine also includes a combustor assembly coupled in flow communication with the at least one air source, the at least one fuel source and the at least one cooling fluid source. The combustor assembly includes a first chamber and a second chamber coupled in flow communication with said first chamber. The assembly also includes at least one venturi device between the first and second chambers, wherein the venturi device is oriented with a predetermined venturi step angle greater than approximately 48°.

DETAILED DESCRIPTION OF THE INVENTION

Figure 1:
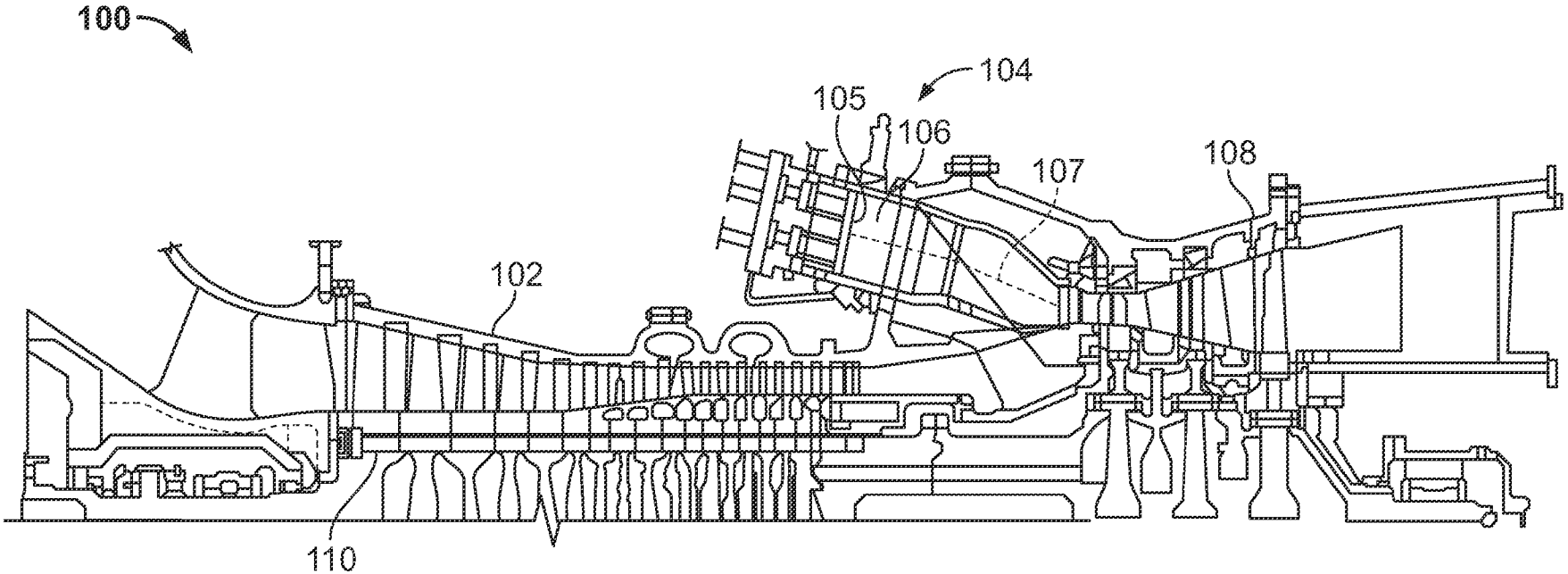
FIG. 1 is a cross-sectional schematic view of an exemplary gas turbine engine.

FIG. 1 is a schematic illustration of an exemplary gas turbine engine 100. Engine 100 includes a compressor 102 and a combustor assembly 104. Combustor assembly 104 includes a combustor assembly wall 105 that at least partially defines a combustion chamber 106. Combustion chamber 106 has a centerline 107 that extends therethrough. In the exemplary embodiment, engine 100 includes a plurality of combustor assemblies 104. Combustor assembly 104, and, more specifically, combustion chamber 106 is coupled downstream from and in flow communication with compressor 102. Engine 100 also includes a turbine 108 and a compressor/turbine shaft 110 (sometimes referred to as a rotor). In the exemplary embodiment, combustion chamber 106 is substantially cylindrical and is coupled in flow communication with turbine 108. Turbine 108 is rotatably coupled to, and drives, shaft 110. Compressor 102 is also rotatably coupled to shaft 110. In the exemplary embodiment, combustor 104 is a dry low nitrogen oxide ($NO_x$), or DLN-type combustor, specifically, a DLN 1+ combustor commercially available from General Electric Company, Greenville, S.C. Alternatively, combustor 104 is any combustor that facilitate operation of engine 100 as described herein.

In operation, air flows through compressor 102 and a substantial amount of compressed air is supplied to combustor assembly 104. Assembly 104 is also in flow communication with a fuel source (not shown in FIG. 1) and channels fuel and air to combustion chamber 106. In the exemplary embodiment, combustor assembly 104 ignites and combusts fuel, for example, natural gas and/or fuel oil within combustion chamber 106 that generates a high temperature combustion gas stream (not shown in FIG. 1) of at least approximately 1100 degrees Celsius (° C.) (2020 degrees Fahrenheit (° F.)), for example. Alternatively, assembly 104 combusts fuels that include, but are not limited to, process gas and/or synthetic gas (syngas). Combustor assembly 104 channels the combustion gas stream to turbine 108 wherein gas stream thermal energy is converted to mechanical rotational energy.

Figure 2:
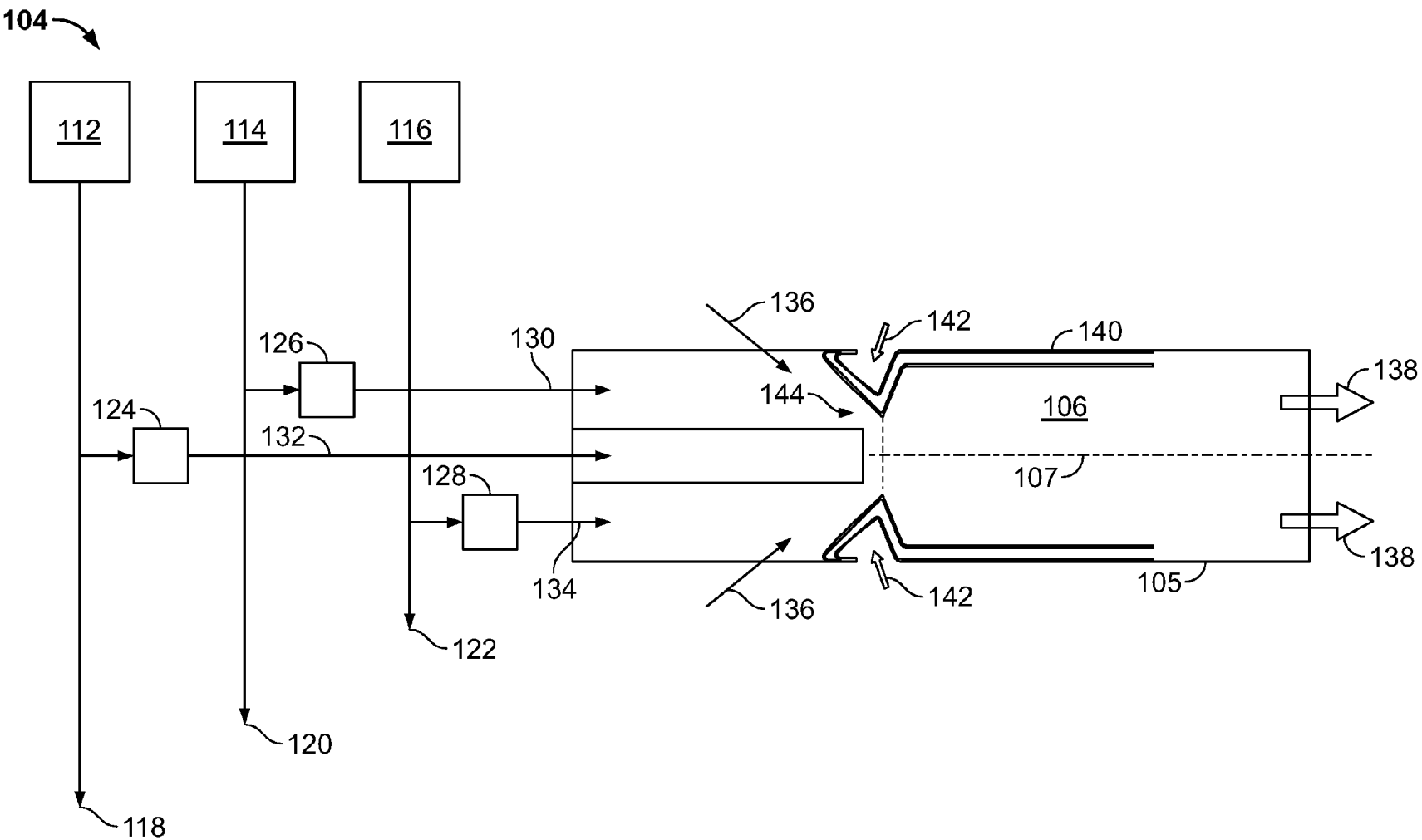
FIG. 2 is an enlarged schematic view of a portion of an exemplary combustor assembly that may be used with the gas turbine engine shown in FIG. 1.

FIG. 2 is an enlarged schematic view of a portion of combustor assembly 104. Combustion chamber centerline 107 is illustrated for perspective. Assembly 104 is coupled in flow communication to a plurality of fuel sources 112, 114 and 116 via a plurality of fuel conduits 118, 120 and 122, respectively, and a plurality of fuel control valves 124, 126 and 128, respectively. Conduits 118, 120 and 122 are coupled in flow communication with other assemblies 104 (not shown). Valves 124, 126 and 128 are coupled in flow communication with a plurality of fuel nozzles 130, 132 and 134, respectively.

Combustor assembly 104 receives air from compressor 102 (shown in FIG. 1), through a plurality of air ports (not shown) as combustion air streams 136. Assembly 104 mixes fuel and air within chamber 106, that when ignited forms a combustion gas stream 138 that is channeled to turbine 108 (shown in FIG. 1). Assembly 104 also includes a venturi device 140 that is coupled to compressor 102, such that venturi device 104 receives at least one cooling fluid stream 142 therethrough. In the exemplary embodiment, venturi device 140 at least partially defines a fuel-air premixing chamber 144 and combustion chamber 106. Chamber 144 is in flow communication with nozzles 130, 132, and 134, as well as combustion chamber 106.

Figure 3:
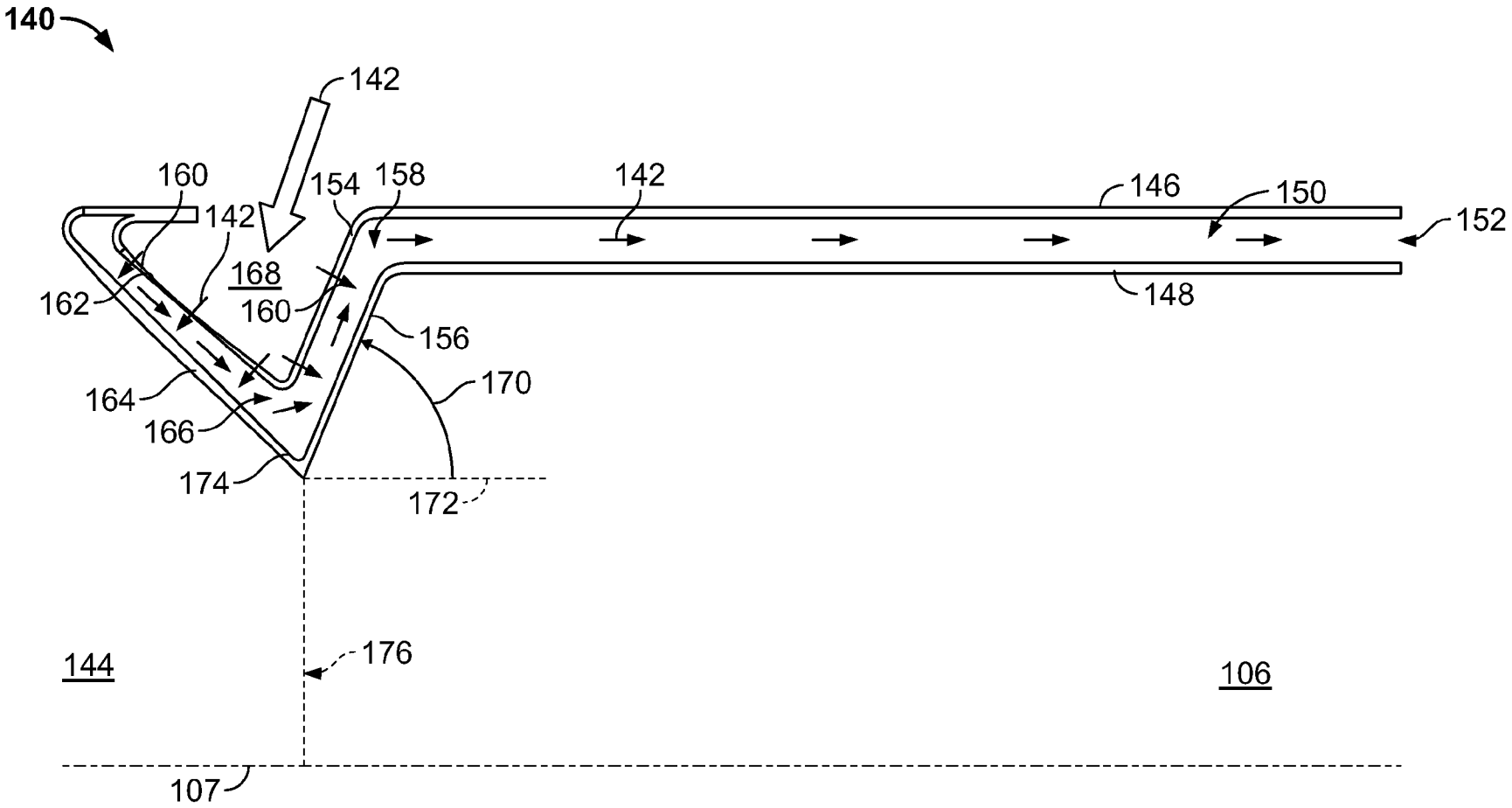
FIG. 3 is a cross-sectional schematic view of a portion of an exemplary venturi device that may be used with the combustor assembly shown in FIG. 2.

FIG. 3 is a cross-sectional schematic view of a portion of exemplary venturi device 140 that may be used with combustor assembly 104 (shown in FIG. 2). In the exemplary embodiment, venturi device 140 is substantially cylindrical. Alternatively, device 140, and/or combustor 104, are of any size, shape, orientation and/or configuration that facilitates operation of device 140 as described herein. Device 140 includes a plurality of walls, or more specifically, a first outer wall 146 and a first inner wall 148. Walls 146 and 148 are aligned substantially concentrically with respect to centerline 107 and at least partially define an annular cooling fluid passage 150 and an annular cooling fluid discharge port 152. In the exemplary embodiment, passage 150 is coupled in flow communication with combustion chamber 106 via port 152. Alternatively, passage 150 is coupled in flow communication with any portion of engine 100 that facilitates operation of engine 100 as described herein.

Device 140 also includes a second outer wall 154 and a second inner wall 156. In the exemplary embodiment, walls 154 and 156 are substantially parallel to each other and at least partially define a second cooling fluid passage 158. Walls 154 and 156 are coupled to and extend from, walls 146 and 148, respectively. Moreover, in the exemplary embodiment, second passage 158 is coupled in flow communication with first passage 150 and wall 154 includes at least one cooling fluid opening 160 extending therethrough.

In the exemplary embodiment, device 140 also includes a third outer wall 162 and a third inner wall 164. Moreover, in the exemplary embodiment, walls 162 and 164 are substantially parallel to each other and at least partially define a third cooling fluid passage 166. Walls 162 and 164 are coupled to walls 154 and 156, respectively. Moreover, third passage 166 is coupled in flow communication with second passage 158. Wall 162 includes at least one cooling fluid opening 160 extending therethrough.

Inner walls 162 and 154 at least partially define a cooling fluid plenum 168. In the exemplary embodiment, plenum 168 extends substantially circumferentially about device 140 and is coupled in flow communication with compressor 102. Plenum 168 is also coupled in flow communication with passages 158 and 166 via openings 160. In the exemplary embodiment, wall 156 defines a venturi step angle 170 with respect to a line 172 extending substantially parallel to centerline 107. Moreover, walls 164 and 156 form a substantially annular apex 174 that at least partially defines a throat region 176. More specifically, throat region 176 separates chambers 106 and 144.

An exemplary method of assembling a turbine engine includes defining chamber 144 and defining chamber 106. The method also includes positioning at least one venturi device 140 to be oriented with a predetermined venturi step angle 170 greater than approximately 48°. The method further includes coupling chamber 144 in flow communication with chamber 106 such that venturi device 140 is therebetween.

In operation, referring to FIGS. 2 and 3, fuel nozzles 130, 132 and 134 channel a plurality of fuel streams (not shown) into premixing chamber 144 from fuel sources 112, 114 and 116 via respective conduits 118, 120, and 122 and control valves 124, 126 and 128. Air streams 136 are also channeled into chamber 144 from compressor 102, wherein the fuel and air are mixed together to form a fuel-air mixture (not shown). The fuel-air mixture is channeled through throat region 176 into combustion chamber 106, wherein the fuel-air mixture is combusted, thereby forming a combustion gas stream 138 that is channeled to turbine 108.

Also, during operation, cooling fluid stream 142 is channeled into plenum 168. In the exemplary embodiment, the cooling fluid used in stream 142 is air channeled from compressor 102. Alternatively, the cooling fluid may be any fluid that facilitates operation of combustor 104 as defined herein, including, but not limited to, steam, water, and ethylene glycol. Fluid stream 142 is channeled from plenum 168 into third and second fluid passages 166 and 158, respectively, via openings 160. Fluid stream 142 is also channeled into first fluid passage 150 and into chamber 106 via port 152. As such, at least a portion of heat released by combustion of the fuel-air mixture within combustion chamber 106 is removed by fluid stream 142.

Thermal $NO_x$ is typically defined as $NO_x$ formed during combustion of fuel and air through the high temperature oxidation of nitrogen found in air. Specifically, the $NO_x$ formation rate is a function of the ratio of air as referenced to fuel, a temperature associated with the combustion of fuel and air within a pre-defined region, and the residence time of nitrogen at that temperature and in the combustor. Therefore, in general, as any of the percentage of fuel in the fuel-air mixture, the temperature of combustion, and/or the residence time increases, a rate of $NO_x$ generation increases as well. In contrast, decreasing the concentration of fuel in the fuel-air mixture towards limits of lean-flammability facilitates mitigating $NO_x$ generation. Moreover, optimizing residence times and temperatures facilitates complete combustion and facilitates the mitigation of $NO_x$ generation.

In the exemplary embodiment, during operation, lean premixed injection is used. Such injection methods include mixing air and fuel prior to injection within combustion chamber 106. Mixing air and fuel prior to injection facilitates attaining uniformity within fuel-air mixtures, which facilitates optimizing residence times and temperatures associated with combustion. Moreover, such lean premixed combustion methods are typically characterized by lower flame temperatures than those typically characterized by traditional non-premixed, or diffusion, methods of combustion. The lower combustion temperatures associated with the lean premixed combustion facilitates reducing in the rate and magnitude of formation of $NO_x$, however, the lower temperatures may undesirably facilitate increased carbon monoxide (CO) formation due to a reduction in combustion efficiency. Moreover, potentials for lean-blow out, or flame-out (conditions wherein the flame cannot be maintained) and high frequency dynamic pressure oscillations are increased. Improved flame stabilization facilitates decreasing potentials for CO formation, lean-blow out and high frequency dynamics.

Flame stability, completeness of combustion, and $NO_x$ production may be affected by turbulence of the fuel-air mixture prior to combustion. Specifically, increasing turbulence may facilitate decreasing the residence times and the peak and local temperatures of combustion of fuel and air, thereby facilitating a decrease in $NO_x$ production. Other factors such as, but not limited to, fuel-air mixture flow velocities and mass flow rates, facilitate forming predetermined vortices (not shown) that include at least one localized flow field (not shown) that is defined within a predetermined volume and with a predetermined set of characteristics, such as, but not limited to, a predetermined turbulence, residence time and temperature.

In addition, flame-holding is facilitated when a residence time of a mixture of fuel and air in a pre-defined volume is greater than the fuel-air mixture's reaction time within the same volume, and a resultant flame as a result of combustion of fuel and air is realized. Specifically, when a flame speed is substantially similar to a fuel-air mixture flow speed, a resultant flame may be characterized as stable.

As is known in the art, a venturi device orientation similar to device 140 may be used to stabilize a combustion flame (not shown) downstream of device 140 within chamber 106. Venturi device 140 facilitates flame stabilization by receiving the premixed fuel-air mixture from premix chamber 144 and accelerating the mixture into combustion chamber 106 through throat region 176. Such acceleration into combustion chamber 106 facilitates the formation of vortices and recirculation zones downstream of venturi device 140 within chamber 106, as discussed further below.

Venturi device 140 facilitates forming vortices that include multiple localized flow fields (not shown). Specifically, venturi device 140 acts as a bluff-body that facilitates flame-holding. More specifically, device 140 includes a non-streamlined shape that induces sufficient resistance into the flow of the air-fuel mixture into chamber 106, thereby forming a wake region (not shown) in radially outboard regions (not shown) of chamber 106. As such, vortex formation is facilitated downstream of device 140. Moreover, vortex formation also facilitates vortex breakdown wherein at least one recirculation zone (not shown) between the bulk flow field and wall 148 forms and the fuel-air mixture exits the bulk flow field into the recirculation zone. The fuel-air mixture is then re-injected back into the bulk flow field, thereby facilitating increasing bulk flow field turbulence, and subsequently decreasing fuel and air residence time, combustion temperatures within the bulk flow field, and $NO_x$ formation. Therefore, such recirculation zones facilitate flame stabilization.

In the exemplary embodiment, venturi step angle 170 is greater than approximately 48°. Because angle 170 exceeds approximately 48°, flame-holding properties within combustion chamber 106, downstream from venturi device 140, are further facilitated, thereby further facilitating flame stability. Moreover, such values for angle 170 facilitate optimizing residence times and temperatures, thereby facilitating complete combustion and reduced $NO_x$ formation. In the exemplary embodiment, $NO_x$ concentrations within combustion gas stream 138 are below about 3 parts per million, volumetric dry (ppmvd). Furthermore, such improved flame stabilization facilitates decreasing potentials for CO formation, lean-blow out, and high frequency dynamics. Moreover, in the exemplary embodiment, CO concentrations within combustion gas stream 138 are below about 25 ppmvd. As such, the reduction in combustion by-products facilitates reducing a need for exhaust gas scrubbing apparatus.

The gas turbine engine and combustor assembly described herein facilitates mitigating combustion product emissions while facilitating a pre-determined heat release rate per unit volume. Specifically, the engine includes a lean premixed injection combustor assembly that facilitates thorough and rapid fuel and air mixing and combustion. More specifically, such combustor assembly includes a venturi device with a venturi step angle greater than approximately 48°. Such step angle facilitates a reduction in $NO_x$, increased flame stability, increased combustion efficiency as measured by CO formation, and mitigation of undesirable combustion dynamics. As a result, the operating efficiency of such engines may be increased and the engine's operational costs may be reduced. Moreover, such engines' combustion by-products are reduced, thereby reducing a need for expenditures of capital and operating funds associated with exhaust gas scrubbing apparatus.

Exemplary embodiments of combustor assemblies as associated with gas turbine engines are described above in detail. The methods, apparatus and systems are not limited to the specific embodiments described herein nor to the specific illustrated gas turbine engines and combustor assemblies.

While the invention has been described in terms of various specific embodiments, those skilled in the art will recognize that the invention can be practiced with modification within the spirit and scope of the claims.

What is claimed is:

1. A method of assembling a turbine engine, said method comprising:

coupling a first chamber in flow communication with a plurality of fuel nozzles and a plurality of air streams, such that the first chamber premixes fuel from the plurality of fuel nozzles with air from the plurality of air streams, wherein the fuel is at least one of natural gas, fuel oil, process gas, and synthetic gas;

defining a second chamber configured to combust the premixed fuel and air into a combustion gas stream having a temperature of at least approximately 1100 degrees Celsius, wherein a centerline extends through the second chamber; and coupling the first chamber in flow communication with the second chamber using at least one venturi device coupled between the two chambers, wherein the at least one venturi device includes at least one first wall substantially parallel to the centerline, at least one second wall oriented with a predetermined venturi step angle that is greater than approximately 48 degrees as defined by the at least one second wall and a line extending substantially parallel to the centerline, and at least one third wall oriented at an oblique angle with respect to the centerline and coupled at an apex to said at least one second wall, and wherein the predetermined venturi step angle facilitates the formation of recirculation zones within the second chamber such that a nitrogen oxide concentration in the combustion gas stream is maintained below about 3 ppmvd, and such that the at least one venturi device defines a cooling fluid plenum and a plurality of cooling fluid passages coupled in flow communication via a plurality of cooling fluid openings, and wherein the plenum is radially outward from the apex and configured to receive cooling fluid through an aperture defined radially outward from and adjacent to the plenum.

2. A method in accordance with claim 1 further comprising:

coupling the first wall to the second wall such that the second wall is oriented with the predetermined venture step angle.

3. A method in accordance with claim 2 wherein coupling the first wall to the second wall comprises sizing the venturi step angle to facilitate flame stability within the second chamber.

4. A method in accordance with claim 2 further comprising:

forming a plurality of first walls substantially concentrically about the centerline, wherein the plurality of first walls at least partially define at least one first cooling fluid passage therebetween;

forming a plurality of second walls oriented to at least partially define at least one second cooling fluid passage therebetween; and coupling the at least one second cooling fluid passage in flow communication with the at least one first cooling fluid passage.

5. A method in accordance with claim 4 further comprising:

forming a plurality of third walls oriented to at least partially define at least one third cooling fluid passage therebetween; and coupling the at least one third cooling fluid passage in flow communication with the at least one second cooling fluid passage.

6. A combustor assembly comprising:

a first chamber coupled in flow communication with a plurality of fuel nozzles and a plurality of air streams, said first chamber configured to premix fuel from said plurality of fuel nozzles with air from said plurality of air streams, wherein the fuel is at least one of natural gas, fuel oil, process gas, and synthetic gas;

a second chamber configured to combust the premixed fuel and air into a combustion gas stream having a temperature of at least approximately 1100 degrees Celsius, said second chamber coupled in flow communication with said first chamber, wherein a centerline extends through said second chamber; and at least one venturi device coupled in flow communication between said first and second chambers, wherein said venturi device comprises at least one first wall substantially parallel to the centerline, at least one second wall oriented with a predetermined venturi step angle that is greater than approximately 48 degrees as defined by said at least one second wall and a line extending substantially parallel to the centerline, and at least one third wall oriented at an oblique angle with respect to the centerline and coupled at an apex to said at least one second wall, said predetermined venturi step angle facilitates the formation of recirculation zones within said second chamber such that a nitrogen oxide concentration in the combustion gas stream is maintained below about 3 ppmvd, wherein said at least one venturi device defines a cooling fluid plenum and a plurality of cooling fluid passages, said cooling fluid plenum and said plurality of cooling fluid passages are coupled in flow communication via a plurality of cooling fluid openings, said plenum is radially outward from the apex and is oriented to receive cooling fluid discharged from an aperture defined radially outward from and adjacent to said plenum.

7. A combustor assembly in accordance with claim 6 wherein said at least one second wall is coupled to said at least one first wall such that said at least one second wall is oriented with a predetermined venture step angle.

8. A combustor assembly in accordance with claim 6 wherein: said at least one first wall comprises a plurality of first walls substantially concentric about the centerline, wherein said plurality of first walls at least partially define at least one first cooling fluid passage of said plurality of cooling fluid passages therebetween; said at least one second wall comprises a plurality of second walls oriented to at least partially define at least one second cooling fluid passage of said plurality of cooling fluid passages therebetween, wherein said at least one second cooling fluid passage is coupled in flow communication with said at least one first cooling fluid passage; and said at least one third wall comprises a plurality of third walls oriented to at least partially define at least one third cooling fluid passage of said plurality of cooling fluid passages therebetween, wherein said at least one third cooling fluid passage is coupled in flow communication with said at least one second cooling fluid passage.

9. A combustor assembly in accordance with claim 6 wherein said venturi step angle is sized to facilitate flame stability within the second chamber.

10. A turbine engine, said engine comprising:

at least one air source;

at least one fuel source;

at least one cooling fluid source; and a combustor assembly comprising;

a first chamber coupled in flow communication with a plurality of fuel nozzles coupled to said at least one fuel source and a plurality of air streams coupled to said at least one air source, said first chamber configured to premix fuel from said plurality of fuel nozzles with air from said plurality of air streams, wherein the fuel is at least one of natural gas, fuel oil, process gas, and synthetic gas;

a second chamber configured to combust the premixed fuel and air into a combustion gas stream having a temperature of at least approximately 1100 degrees Celsius, said second chamber coupled in flow communication with said first chamber and having a centerline extending therethrough; and at least one venturi device coupled in flow communication between said first and second chambers, wherein said venturi device comprises at least one first wall substantially parallel to the centerline, at least one second wall oriented with a predetermined venturi step angle that is greater than approximately 48 degrees as defined by said at least one second wall and a line extending substantially parallel to the centerline, and at least one third wall oriented at an oblique angle with respect to the centerline and coupled at an apex to said at least one second wall, said predetermined venturi step angle facilitates the formation of recirculation zones within said second chamber such that a nitrogen oxide concentration in the combustion gas stream is maintained below about 3 ppmvd, wherein said at least one venturi device defines a cooling fluid plenum and a plurality of cooling fluid passages, said cooling fluid plenum and said plurality of cooling fluid passages are coupled in flow communication via a plurality of cooling fluid openings, said plenum is radially outward from the apex and is oriented to receive cooling fluid from said at least one cooling fluid source discharged from an aperture defined radially outward from and adjacent to said plenum.

11. A turbine engine in accordance with claim 10 wherein said at least one second wall is coupled to said at least one first wall such that said at least one second wall is oriented with the predetermined venturi step angle.

12. A combustor assembly in accordance with claim 10 wherein: said at least one first wall comprises a plurality of first walls substantially concentric about the centerline, wherein said plurality of first walls at least partially define at least one first cooling fluid passage of said plurality of cooling fluid passages therebetween; said at least one second wall comprises a plurality of second walls oriented to at least partially define at least one second cooling fluid passage of said plurality of cooling fluid passages therebetween, wherein said at least one second cooling fluid passage is coupled in flow communication with said at least one first cooling fluid passage; and said at least one third wall comprises a plurality of third walls oriented to at least partially define at least one third cooling fluid passage of said plurality of cooling fluid passages therebetween, wherein said at least one third cooling fluid passage is coupled in flow communication with said at least one second cooling fluid passage.

13. A turbine engine in accordance with claim 12 wherein said at least one first, second and third cooling fluid passages are configured to channel the at least one cooling fluid comprising one of air, steam, water, and ethylene glycol.

14. A turbine engine in accordance with claim 10 wherein said venturi step angle is sized to facilitate flame stability within the second chamber.

* * * * *